United States Patent [19]

Peter et al.

[11] Patent Number: 4,827,050

[45] Date of Patent: May 2, 1989

[54] METHOD FOR SEPARATION OF PHENOLS AND BASES FROM COAL TAR OILS BY EXTRACTION

[75] Inventors: Siegfried Peter, Uttenreuth-Weiher; Marc Seekamp, Erlangen; Herbert Beneke, Castrop-Rauxel; Jürgen Stadelhofer, Bad Soden, all of Fed. Rep. of Germany

[73] Assignee: Rütgerwerke Aktiengesellschaft, Frankfurt am Main, Fed. Rep. of Germany

[21] Appl. No.: 25,473

[22] Filed: Mar. 13, 1987

[30] Foreign Application Priority Data

Dec. 10, 1986 [DE] Fed. Rep. of Germany ..... 3610369

[51] Int. Cl.[4] ..... C07C 37/68; C07C 37/70

[52] U.S. Cl. ..... 568/761; 568/749

[58] Field of Search ..... 568/757, 761, 762, 749

[56] References Cited

U.S. PATENT DOCUMENTS 2,301,270 11/1942 Gerlicher ..... 568/761
2,321,036 6/1943 Luten, Jr. ..... 568/757
2,997,477 8/1961 Eisenlohr et al. ..... 568/762
4,345,976 12/1985 Siegfried et al. ..... 203/49
4,559,133 8/1982 Peter et al. ..... 208/177

FOREIGN PATENT DOCUMENTS 300499 6/1971 USSR ..... 588/749

*Primary Examiner*—Werren B. Lone
*Attorney, Agent, or Firm*—Horst M. Kasper

[57] ABSTRACT

Coal tar oil is separated quantitatively into neutral oil, phenols and bases by a two stage extraction with overcritical gases. Carbon dioxide is employed as an overcritical extraction agent, and propane or butane are preferably added as entrainers. The neutral oil is obtained in the first stage. Tar bases can be employed as an additional entrainer for improving the selectivity. The bases are extracted in the second stage. The method is associated with the advantage that it saves energy and that no byproducts are generated.

22 Claims, 1 Drawing Sheet

METHOD FOR SEPARATION OF PHENOLS AND BASES FROM COAL TAR OILS BY EXTRACTION

BACKGROUND OF THE INVENTION

1. Field of the Invention

The present invention relates to a method for separating phenols and bases from coal tar oils.

2. Brief Description of the Background of the Invention Including Prior Art

Carbolic acid oil boiling between 180° and 210° C. and obtained in an amount of from about 2 to 3% of the hard coal tar during the primary distillation comprises in addition to homologues of benzene, naphthalene and bases up to 35% phenols, which comprise a mixture of phenol, creosols and xylenols (Franck, Collin: Bituminous Coal Tar, p. 74) In addition the filtered naphthalene oil, with a phenol content up to 25%, obtained in particular during the crystallization of naphthalene and the light oil containing up to 10% phenols are used to obtain phenols. The most important method for obtaining phenol from these coal tar oils is sodium hydroxide extraction (Franck, Collin: Bituminous Coal Tar, pp. 75–77). The method is based on the fact that phenols are weak acids and therefore they form water soluble salts with bases and that the phenols can be precipitated again with stronger acids such as for example, carbonic acid.

The phenol containing coal tar oil is relieved of the phenol with an 8 to 12% aqueous sodium hydroxide solution in two stages. The phenols pass during this process into the sodium hydroxide solution under formation of phenolates. The method is performed in most cases at about 50° C. in order to achieve a quicker separation of sodium hydroxide solution and oil.

It is not advisable to employ a lye of higher concentration because in addition neutral oils are dissolved by solubilization into the aqueous phase with increasing content in phenol in the phenolate lye.

The saturated or, respectively, nearly completely saturated phenolate lye is separated from adhering neutral oils by steam distillation until clearing. Following, the phenols are precipitated from the phenolate lye cleared by steam distillation by introduction of carbon dioxide. The carbonic acid required for this purpose is generated in a lime kiln, which is a construction part of the production unit.

After the precipitation, the raw phenol separates above the aqueous sodium solution and can be separated from the sodium solution. The sodium solution is made caustic with lime, which is generated by firing of limestone, and the calcium carbonate generated during caustification is filtered off from the recovered sodium lye. The lye is again set to an alkali content of from 8 to 12% and the lye is again returned into the cycle.

This process requires very much energy to carry out the evaporation and to operate a lime kiln and also involves a series of disadvantages:

(1) After the extraction of the carbolic acid oil with sodium hydroxide NaOH, there remains a residual phenol content of 0.5% in the oil, which cannot economically be recovered.

(2) The about 0.5% organic but non-phenolic parts are removed from the phenolate lye by a following steam distillation process until clearing. This is necessary in order to obtain pure phenol products required by the severe commercial delivery specifications. The heat requirements are reduced in fact by the use of exchange columns filled with packing filling material and by multiple stage evaporation systems, but nevertheless this process still entails substantial cost.

(3) In addition, a mixture of neutral oil tar bases and water is generated as a distillate. Also a small part of the phenol dissolved in the lye is driven off by the water vapor distillation. This part is on the one hand lost in the production process and in addition substantially contaminates the waste water. Also part of the bases are lost even though the distillate water is extracted with benzene or a similar solvent.

(4) The raw phenol, after the separation from the sodium lye, still contains sodium solution, which is removed substantially by renewed washing with water. Finally, the raw phenol still contains about 2% alkali at about 10 to 20% water. The water has to be removed before the fractioning of the raw phenol. The distillate water obtained thereby however is not added to the waste water, but is returned into the circulation system because of a very high phenol content.

(5) The lime sludge generated during the caustification of the sodium lye is very fine-grained and still contains about 50% water when in a form that is proof against sword cuts. (Translator's note: A knife (sword) would remain in place when stuck into the sludge.) Despite multiple washing with water on a vacuum filter, the residual content of 0.5% alkali remains.

(6) The recuperation of the alkali amount at maximum recuperation is only 95%.

The total requirement of chemicals for 1 ton of raw phenol comprises amounts on the average of:

625 kg limestone
68 kg coke
65 kg sodium hydroxide

It has been attempted to lower the loss in chemicals or the loss in phenols due to the precipitated lime or, respectively, to reemploy the precipitated lime in concrete factories or the like in order to avoid environmental pollution ensuing from rain washouts of slag heaps of the precipitated lime.

There has been no lack of attempts to change the method and to at least eliminate the operation of the lime kiln, for example, the Metasolvane method operated with aqueous methanol. However, this Metasolvane method has not been able to achieve widespread acceptance. The Phenoraffin method (Franck, Collin: Bituminous Coal Tar, pp. 77–79) employs sodium phenolate solution for extraction. The oversaturated phenolate lye is washed with benzene or toluene to remove bases and neutral oils. Raw phenol is obtained from the oversaturated phenolate lye by extraction with di-isopropyl ether. This method also has not succeeded in achieving permanent widespread acceptance.

The light oil boiling between 70° and 200° C. and generated in an amount of from 0.5 to 3% of the raw tar during the primary distillation contains 2 to 7% bases (Franck, Collin: Bituminous Coal Tar, p. 84). In addition, carbolic acid oil is employed for obtaining bases.

The bases contained in the oils are obtained by extraction with 25 to 35% sulphuric acid. The coal dissolved neutral oils are removed by washing with a solvent. Thereupon the bases are precipitated by neutralization of the base-sulphuric acid compound. For this purpose, mostly ammonia is employed. The bases are withdrawn and the aqueous solution is worked up by evaporation for obtaining ammonium sulphate (Franck, Collin: Bituminous Coal Tar, ppl 84–85). This procedural method also requires much energy and a large amount of chemicals.

In summary, it is noted that obtaining phenols and bases from tar oils is associated with a high expenditure of thermal energy and chemicals.

SUMMARY OF THE INVENTION

Purposes of the Invention

It is an object of the present invention to develop an extraction method for separation of phenols and bases from coal tar oils that avoids the disadvantages involved in a sodium hydroxide solution extraction.

It is another object of the present invention to provide a method for extracting phenols and bases from coal tar oils that saves energy and is environmentally acceptable.

It is yet another object of the present invention to avoid the by-product generation of large amounts of lime in the production of phenols and bases from coal tar oils.

These and other objects and advantages of the present invention will become evident from the description which follows.

Brief Description of the Invention

The present invention provides a method for separating phenols and bases from coal tar oils in which coal tar oil is fed together with an extraction agent and an entrainer, where the extraction agent and the entrainer form an overcritical extraction agent. The coal tar oils are extracted with the overcritical extraction agent in a first step for separating neutral oils and are extracted with the overcritical extraction agent in a second step for separating bases from phenolic compounds.

The overcritical component can be formed by carbon dioxide, and the entrainer can be provided by a hydrocarbon compound having a chain length of from about 3 to 8 carbon atoms. The overcritical agent can be formed of from about 5 to 80 weight percent carbon dioxide where the entrainer is provided by from about 20 to 95 weight percent propane. Preferably, the overcritical agent is formed of from about 20 to 60 weight percent carbon dioxide where the entrainer is provided by from about 40 to 80 weight percent propane. An additional entrainer comprising bases with a concentration of from about 2 to 30 weight parts, and more preferably 5 to 20 weight parts, as determined relative to the weight part amount of coal tar oil present can be fed in.

A member of the group consisting of collidine, pyridine, alkyl derivatives of pyridine with up to about 20 carbon atoms, amines of the structure

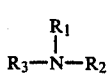

where $R_1$, $R_2$, $R_3$ is defined as a hydrogen atom or an alkyl group with from 1 to 12 carbon atoms can be employed as bases.

Part of the bases resulting in the second step can be fed to a feed of the first stage as an entrainer.

The extraction can be operated according to a counter current principle, and the extraction can be subjected to a pressure of from about 80 to 200 bar and more preferably to a pressure of from about 100 to 120 bar. The extraction can be subjected to a temperature of from about 30 to 100 degrees centigrade and more preferably to a temperature of from about 40 to 60 degrees centigrade.

Part of the extracts obtained in separators can be fed back to a respective column in each case to provide feedback.

Carbon dioxide can be employed as an overcritical agent and butane as an entrainer.

A neutral oil can be completely separated from a gas feed flow after the first stage by pressure decrease to from about 30 to 90 bar, more preferably from about 50 to 70 bar, and heating to a temperature of from about 60 to 150 degrees centigrade, more preferably from about 80 to 100 degrees centigrade.

Bases can be completely separated from a gas feed flow after the second stage by pressure decrease to from about 30 to 90 bar, and preferably from about 50 to 70 bar, and heating to a temperature of from about 60 to 150 degrees centigrade, and more preferably from about 80 to 100 degrees centigrade.

The bases can be separated from the phenols in the second extraction stage at a temperature of from about 10 to 50 degrees, more preferably from about 20 to 40 degrees, higher than the temperature under which the extraction of the neutral oil was performed in the first extraction stage.

Another aspect of the the present invention provides a method for separating phenols and bases from coal tar oils by extraction that comprises extracting the tar oils with an overcritical extraction means under addition of an entrainer in two stages, where in the first stage the neutral oils are separated out and in the second stage the bases are separated from the phenols.

The novel features which are considered as characteristic for the invention are set forth in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

In the accompanying drawing, in which are shown several of the various possible embodiments of the present invention.

DESCRIPTION OF INVENTION AND PREFERRED EMBODIMENTS

Figure 1:
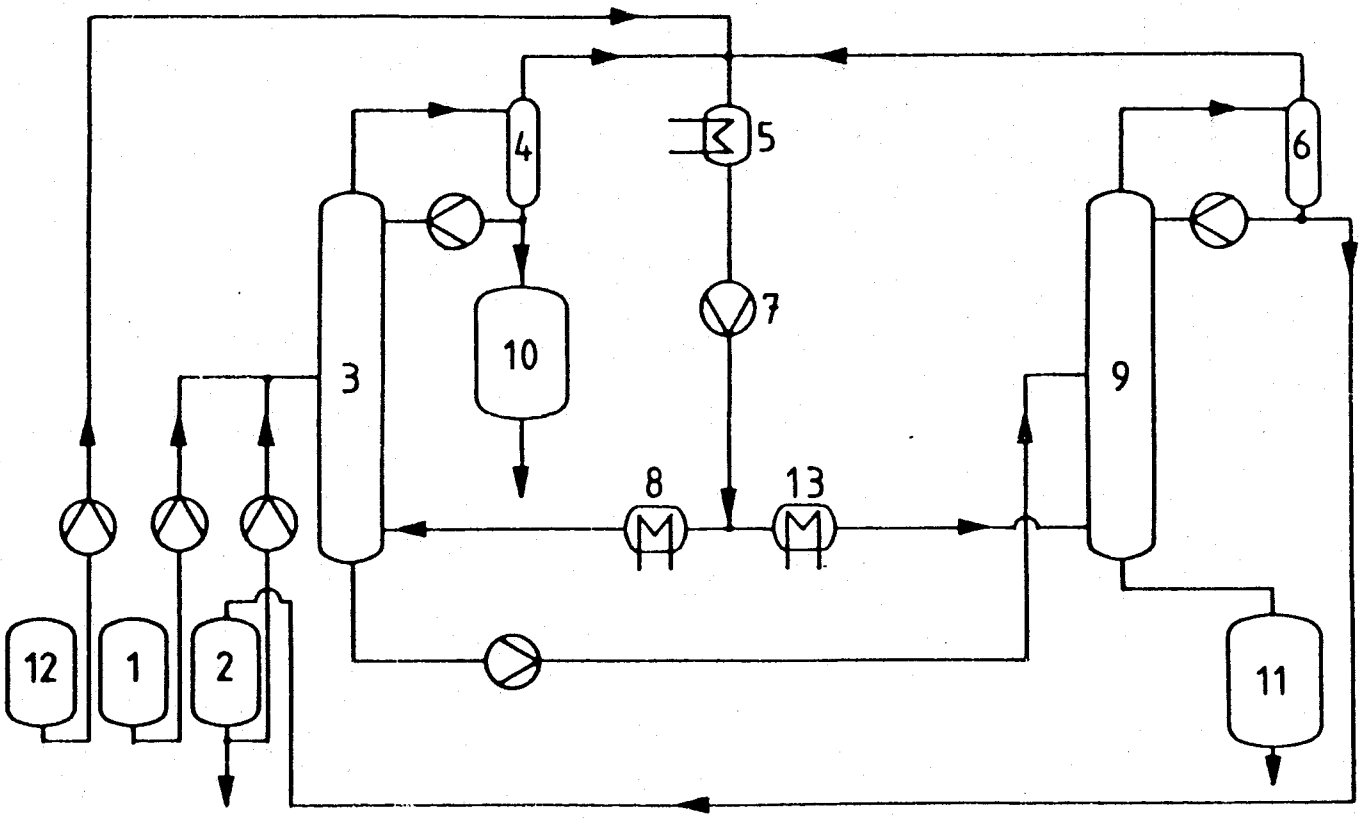
FIG. 1 is a view of a schematic process diagram illustrating the fluid flow according to the invention process.

According to the present invention, a separation of phenols and bases from coal tar oil is achieved by extraction with the aid of overcritical extraction agents, which comprise an overcritical material and an undercritical entrainer in a two stage process. The neutral oil is separated in the first stage. The bases are separated in the second stage. $CO_2$ mixed with a hydrocarbon with a chain length of from 3 to 8 carbon atoms, such as propane or butane, and in an amount of 5 to 80 weight percent, preferably of 20 to 60 weight percent, as referred to the $CO_2$ is employed as an entrainer under conditions where pressure and temperature are selected such that the binary mixture becomes overcritical, that is, the point of the state of the system is disposed above the critical curve in a single phase region. The entrainer can further contain isobutane, n-pentane, isopentane, tetramethylmethane, n-heptane, and isoheptane. A base or a base mixture in an amount of from 2 to 25 weight percent, and preferably in an amount from 5 to 15 weight percent, as referred to the amount of tar oil can be added as a further entrainer for improvement of the selectivity in the first extraction stage. Suitable bases are collidine, pyridine, alkyl derivatives of the pyridines or amines of the general structure $$R_3-\overset{R_1}{N}-R_2$$

where $R_1$, $R_2$ and $R_3$ represent a hydrogen atom or an alkyl group with 1 to 12 carbon atoms.

Loadings of the extraction stage in nearly nonvolatile materials, present in an amount of up to 30 weight percent, with a separating factor alpha between 1.2 and 2, can be obtained under pressures of 80 to 200 bar, preferably 100 to 120 bar, in a temperature region from 30° to 100° C. and preferably in a temperature region from 40° to 60° C.

The separating factor alpha is defined as follows:

$$\text{alpha} = \frac{X_{10}/X_{20}}{X_{11}/X_{21}}$$

where $X_1$ is the mole part of the matter to be extracted and $X_2$ is the mole part of the matter prevailingly remaining in the extraction residue and the indices 0 and 1 characterized the overcritical phase (0) or, respectively, the liquid phase (1).

A neutral oil is obtained as the head product in a counter current column with partial product feedback in the first stage. The neutral oil does not contain any phenols and bases. The residue bottom product contains the phenols and bases. The separation of the neutral oil from the gas stream is performed by gas pressure reduction to 30–90 bar and preferably to 50–70 bar and/or by heating to 60°–150° C., preferably 80°–100 ° C., in a separator.

The mixture of phenols and bases is separated into bases and phenols in the second stage by extraction by a mixture of $CO_2$ with propane as an entrainer. The second extraction stage is performed advantageously at a temperature of from 10–50 degrees Kelvin, preferably 20–40 degrees Kelvin, higher than the temperature of the first stage. Thus the temperature of the second stage can be in the range of from about 40° to 150° C. and preferably from about 50° to 100° C. An association between phenols and bases is effective during the separation of the neutral oil. At a higher temperature, the association becomes weaker, and a separation of bases and phenols becomes easier. While no suitable separation factors for a practical separation are obtainable employing pure $CO_2$ as an overcritical extraction agent, surprisingly, relatively high separation factors alpha of from 1.2 to 1.5 can be obtained by addition of the entrainer propane depending on pressure, temperature and content in phenol. The loading amounts to 5–20 weight percent. In this case, the bases enter into the head product of the counter current extraction and the phenols into the residual bottom product. The bases are separated from the gas stream by pressure reduction to 30–90 bar, preferably 50–70 bar, and/or by heating to 60°–150° C., preferably 80°–100° C., in a separator.

The bases withdrawn as head product of the second extraction stage can in part be fed back as an entrainer or azeotropic agent into the first extraction stage. Corresponding to the base part present in the entered starting material, a further part of the bases is taken as a process product. The phenols remaining as a residue are free from neutral oil and bases.

Eisenbach and Niemann (Erdöl und Kohle-Erdgas, Petrochemie, Vol. 34, (1981), pp. 296–300) report on attempts of benefaction of lignite coal tars with the aid of overcritical $CO_2$, overcritical ethane and propane. According to their teaching, the creosote is extracted selectively with $CO_2$ and the paraffins are extracted selectively with ethane at 55° C. and 200 bars.

However, the materials accompanying the phenols in the bituminous coal tar oil are not aliphatic but are benzene homologues, naphthalenes and tar bases. The benzene homologues with naphthalene provide the so-called neutral oil. If for example, carbolic acid oil is extracted with overcritical $CO_2$ or ethane, then no selective separation of neutral oil and phenols is observed within the analytical error limits. In addition, the extraction of carbolic acid oil without bases with mixtures of $CO_2$ and propane does not allow recognition of any selective solubility in view of separation of the neutral oils from the phenols. Only the addition of a base mixture as a further entrainer results in a noticeable selectivity. The neutral oil is then preferably dissolved. The amount in bases, however, should not exceed the stoichiometric amount required for neutralization. Good results are obtained if just enough base is added so that the basic content corresponds approximately to half the content of phenols in the tar oil considered in the given case.

The following examples are intended to illustrate further in detail the process according to FIG. 1 without limiting the invention to this process.

EXAMPLE 1

100 weight percent carbolic acid oil with 24.0 weight percent phenols, 3.2 weight percent tar bases and 72.8 weight percent neutral oils from tank 1 are fed with 9 weight percent tar bases from tank 2 into the middle of a counter current column 3. Carbon dioxide, which contains 30 weight percent of propane relative to the amount of $CO_2$ present, flows under a pressure of 110 bars and at a temperature of 40° C. from the bottom to the top through the counter current column 3. The column contains a wire fabric packing (Sulzer). The loading of the mixture of $CO_2$ and propane with hard to evaporate compounds amounts to 20 weight percent.

The extraction agent leaving the head of the column contains neutral oil, in which only traces of bases and phenols are present. The dissolved neutral oil is for practical purposes completely separated by volume expansion of the extract to 70 bars and thermal heating to 130° C. in the separator 4 following the column. Part of the neutral oil is fed to the head of the counter current column 3 in order to set a reflux ratio of 3. The balance is intermediately stored in tank 10. The gas leaving the separator 4 is cooled in the cooler 5 jointly with the gas from the separator 6 and is returned into the gas circulation after passing of a preheater 8, 13.

The bottom product of the column 3, containing phenols and bases (36.2 weight percent), is fed into the middle part of the counter current column 9 of the second stage. Here a counter current extraction with carbon dioxide containing 30 weight percent propane as a separating agent or entrainer occurs at 110 bars and 60° C. The obtained loading of the extraction agent amounts to 7–8 weight percent. The bases are obtained as a head product under a separating factor alpha of more than 1.4. The phenols are withdrawn as a bottom product and are fed to the phenol processing via tank 11. The extraction agent containing the bases leaves the counter current column 9 at the head and is relieved of the dissolved bases by pressure reduction to 70 bars and thermal heating to 130° C. in the separator stripper.

The separated bases contain only traces of neutral oils and phenols. A part of the bases is entered at the head of the column 9 for setting of a reflux ratio of 4. The balance is intermediately stored in tank 2 in order to be fed to the base reprocessing or in order to serve as an additional azeotropic agent or entrainer for the first extraction stage. Losses of extraction agents are compensated by mixtures of $CO_2$ and propane present in the pressure container 12.

The schematic diagram of FIG. 1 provides additionally the following features. The pressure container is connected via a compressor to the cooler 5. In addition the fluid leaving the head of the separator 4 is fed to the cooler 5. Furthermore the fluid leaving the head of the separator 6 is fed to the cooler 5. The cooler 5 provides for appropriate cooling of these fluids. The fluids coming from cooler 5 are then passed through a compressor 7 and enter the preheaters 8 and 13. The fluids are then entered at the bottom of the columns 3 and 9. Material containing phenols and bases can be removed from the bottom of the column 3, compressed and then fed to about the middle of column 9. The bottom product of column 9 containing phenols is collected in a storage container 11. This storage container 11 substantially will contain the residue of the extraction process.

Column 3 is fed with coal tar oil from a storage container 1, which coal tar is compressed in a compressor and fed to about the middle of column 3. The neutral oils contained in the coal tar oil are separated from the phenols and bases in column 3 and leave column 3 at the head with the extract agent and are fed into the separator 4. The neutral oils are separated out and leave at the bottom of the separator 4 and are in part refluxed through the head of the column 3, preferably via a compressor. The balance of the neutral oil product is placed in a storage container 10.

The column 9 produces at its top the bases mixed with the extraction agent. This mixture is fed to the separator 6. The bases leave the separator 6 at the bottom and in part are fed back to column 9 via a compressor as a reflux. The balance of the bases product is fed to storage tank 2, where they can either be used as a product or can be compressed to be fed to about the middle of column 3 as an additional entrainer to the carbon dioxide. The phenols are withdrawn at the bottom of column 9 as a residue product of the extraction process and are stored in the storage container 11.

EXAMPLE 2

Carbonic acid oil and collidine from tank 1 and tank 2 are fed at about the middle into the counter current column 3. The amount of collidine is set such that a mixture with about 10% in bases is generated. Carbon dioxide, which contains 63 weight percent propane, flows through the counter current column 3 from the bottom to the top. The pressure in the column amounts to 110 bar. The temperature in the column is 40° C. The column contains a wire fabric (Sulzer packing) as a packing material. The loading of the mixture of $CO_2$ and propane with slow evaporating and next to nonvolatile compounds amounts to 20 weight percent. The extraction agent leaving the column at the head contains neutral oil with only traces of bases and phenols. The dissolved neutral oil is practically completely separated by pressure reduction of the extract to 70 bar and by heating to 130° C. in the separator 4 following to the column 3. A part of the neutral oil is fed as a reflux to the head of the counter current column. The gas leaving the separator 4 is cooled in the cooler 5 jointly with the gas coming from the separator 6 and it is fed back with the compressor 7 into the gas circulation after passing of the preheater 8, 13.

The bottom residue product containing the phenols and bases from the column 3 is fed into the center part of the counter current column 9 of the second stage as a feed. Here a counter current extraction with $CO_2$ containing 63 weight percent propane as an entrainer occurs at 110 bars and 40° C. The loading of the extraction agent obtained here amounts to about 15 weight percent. Bases are obtained as a head product in the case of a separation factor alpha larger than 1.3. The phenols are withdrawn as a bottom residue product. The extraction agent containing the bases leaves the counter current column 9 at the head and is separated from the dissolved bases by pressure reduction to 70 bars and heating to 130° C. in the separator 6. The separated bases are distributed into three partial streams, of which the first is fed to the carbolic acid oil as an entrainer of the first stage, the second is fed as a reflux to the extraction column 9. The third part of the separated bases is taken off as a product stream with the bases fed in with carbolic acid oil.

EXAMPLE 3

Carbolic acid oil and diethylamine are pumped into the center part of the counter current column 3 of the first process stage. The amount of diethylamine is measured such that a mixture with a content of 10 weight percent of diethylamine as referred to the amount of carbolic acid oil present is generated. The counter current column 3 contains a flow from the bottom to the top of carbon dioxide. The pressure in the column amounts to 135 bar and the temperature is 40° C. The column contains a wire grid (Sulzer packing) as a packing material. The loading of the $CO_2$ with nearly nonvolatile compounds amounts to 20 weight percent.

The extraction agent leaving the column 3 at the head contains neutral oil with only traces of bases and phenols present. The dissolved neutral oil is for practical purposes completely separated in the separator 4 following to the column 3 by pressure reduction to 70 bar and heating to 130° C. A part of the neutral oil is fed as a reflux to the head of the counter current column 3. The gas leaving the separator 4 is cooled in the cooler 5 jointly with the gas from the separator 6 and is fed with the compressor 7 to the gas circulation after passing a preheater 8, 13.

The bottom residue product of column 3, which contains phenols and bases, is fed into the center part of the counter current column 9 of the second process stage as a feed. A counter current extraction with carbon dioxide is performed here at 135 bar and 70° C. The obtained loading of the extraction agent amounts to about 3 weight percent. In the case of a separating factor of about 0.85, the bases are obtained as a head product. The phenols are withdrawn as bottom residue product. The extraction agent containing the bases leaves the counter current column 9 at the head and is relieved of the dissolved bases by pressure reduction to 70 bar and heating to 130° C. The separated bases are subdivided into three partial streams, of which the first is added to the carbolic acid oil of the first stage as an entrainer, the second is fed as a reflux of the extraction column 9 and the third is withdrawn as a product stream. The diethylamine can be recovered from the base mixture by distillation.

A quantitative separation of phenols, bases and neutral oils as contained in the fractions of the bituminous coal tar is possible according to the invention method in an environmentally acceptable process, which process needs relatively small amounts of energy and does not leave residues.

It will be understood that each of the elements described above, or two or more together, may also find a useful application in other types of system configurations and coal tar oil processing procedures differing from the types described above.

While the invention has been illustrated and described as embodied in the context of a method for separation of phenols and bases from coal tar oils by extraction, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A method for separating phenols and bases from coal tar oils comprising feeding together coal tar oil, an extraction agent and an entrainer, where the extraction agent and the entrainer form an overcritical extraction agent;

extracting the coal tar oils with the overcritical extraction agent under conditions where pressure and temperature are selected such that the mixture becomes overcritical in a first step for separating neutral oils; and extracting the coal tar oils with the overcritical extraction agent in a second step for separating coal tar derived bases from phenolic compounds.

2. The method for separating phenols and bases from coal tar oils according to claim 1 wherein the overcritical component is formed by carbon dioxide and where the entrainer is provided by a hydrocarbon compound having a chain length of from about 3 to 8 carbon atoms.

3. The method for separating phenols and bases from coal tar oils according to claim 1 wherein the overcritical agent is formed of from about 5 to 80 weight percent carbon dioxide and where the entrainer is provided by from about 20 to 95 weight percent propane.

4. The method for separating phenols and bases from coal tar oils according to claim 1 wherein the overcritical agent is formed of from about 20 to 60 weight percent carbon dioxide and where the entrainer is provided by from about 40 to 80 weight percent propane.

5. The method for separating phenols and bases from coal tar oils according to claim 1 further comprising feeding in an additional entrainer comprising bases with a concentration of from about 2 to 30 weight parts as determined relative to the weight part amount of coal tar oil present.

6. The method for separating phenols and bases from coal tar oils according to claim 1 further comprising feeding in an additional entrainer comprising bases with a concentration of from about 5 to 20 weight parts as determined relative to the weight part amount of coal tar oil present.

7. The method for separating phenols and bases from coal tar oils according to claim 1 further comprising employing as bases a member of the group consisting of collidine, pyridine, alkyl derivatives of pyridine with up to about 20 carbon atoms, amines of the structure

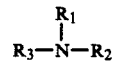

wherein $R_1$, $R_2$, $R_3$ is defined as a hydrogen atom or an alkyl group with from 1 to 12 carbon atoms.

8. The method for separating phenols and bases from coal tar oils according to claim 1 further comprising feeding back part of the bases resulting in the step to a feed of the first stage as an entrainer.

9. The method for separating phenols and bases from coal tar oils according to claim 1 further comprising operating the extraction according to a countercurrent principle; and subjecting the extraction to a pressure of from 80 to 200 bar.

10. The method for separating phenols and bases from coal tar oils according to claim 1 further comprising operating the extraction according to a current principle; and subjecting the extraction to a pressure of from about 100 to 120 bar.

11. The method for separating phenols and bases from coal tar oils according to claim 1 further comprising subjecting the extraction to a temperature of 30 to 100 degrees centigrade.

12. The method for separating phenols and bases from coal tar oils according to claim 1 further comprising subjecting the extraction to a temperature of from about 40 to 60 degrees centigrade.

13. The method for separating phenols and bases from coal tar oils according to claim 1 further comprising feeding part of the extracts obtained in separators back to a respective column in each case to provide feedback.

14. The method for separating phenols and bases from coal tar oils according to claim 1 further comprising employing carbon dioxide as an overcritical agent butane as an entrainer.

15. The method for separating phenols and bases from coal tar oils according to claim 1 further comprising completely separating a neutral oil from a gas feed flow after the first stage by pressure decrease to from about 30 to 90 bar and heating to a temperature of from about 60 to 120 degrees centigrade.

16. The method for separating phenols and bases from coal tar oils according to claim 1 further comprising completely separating a neutral oil from a gas feed flow after the first stage by pressure decrease to from about 50 to 70 bar and heating to a temperature of from about 80 to 100 degrees centigrade.

17. The method for separating phenols and bases from coal tar oils according to claim 1 further comprising completely separating bases from a gas feed flow after the second stage by pressure decrease to from about 30 to 90 bar and heating to a temperature of from about 60 to 120 degrees centigrade.

18. The method for separating phenols and bases from coal tar oils according to claim 1 further comprising completely separating bases from a gas feed flow after the second stage by pressure decrease to from about 50 to 70 bar and heating to a temperature of from about 80 to 100 degrees centigrade.

19. The method for separating phenols and bases from coal tar oils according to claim 1 further comprising separating the bases from the phenols in the second extraction stage at a temperature of from about 10 to 50 degrees higher than the temperature under which the extraction of the neutral oil was performed in the first extraction stage.

20. The method for separating phenols and bases from coal tar oils according to claim 1 further comprising separating the bases from the phenols in the second extraction stage at a temperature of from about 20 to 40 degrees higher than the temperature under which the extraction of the neutral oil was performed in the first extraction stage.

21. A method for separating phenols and bases from coal tar oils by extraction comprising extracting the tar oils with an overcritical extraction means under addition of an entrainer in two stages, where in the first stage the neutral oils are separated out and where in the second stage the bases are separated from the phenols.

22. A method for separating phenols and bases from coal tar oils comprising feeding together coal tar oil, an extraction agent and an entrainer, where the entrainer is provided by a hydrocarbon compound having a chain length of from about 3 to 8 carbon atoms, and where the extraction agent and the entrainer form an overcritical extraction agent;

extracting the coal tar oils with the overcritical extraction agent under conditions where pressure and temperature are selected such that the mixture becomes overcritical in a first step for separating neutral oils; and extracting the coal tar oils with the overcritical extraction agent in a second step for separating coal tar derived bases from phenolic compounds.

* * * * *